United States Patent [19]

Bailey

[11] 4,183,393

[45] Jan. 15, 1980

[54] HEAT INSULATED DOOR

[75] Inventor: Morris W. Bailey, Fort Worth, Tex.

[73] Assignee: Overhead Door Corporation, Dallas, Tex.

[21] Appl. No.: 890,049

[22] Filed: Mar. 27, 1978

[51] Int. Cl.[2] ..... E06B 3/16; E04B 1/62

[52] U.S. Cl. ..... 160/232; 52/309.11; 52/309.9; 52/403; 52/580; 52/802

[58] Field of Search ..... 52/309.9, 309.11, 580, 52/795, 802, 804, 403; 160/232

[56] References Cited

U.S. PATENT DOCUMENTS

| | | | |
|---|---|---|---|
| 3,137,973 | 6/1964 | Williams | 52/403 X |
| 3,153,817 | 10/1964 | Pease, Jr. | 52/309.9 |
| 3,336,713 | 8/1967 | Privas | 52/802 X |
| 3,353,318 | 11/1967 | Bacher | 52/403 |
| 3,386,209 | 6/1968 | Starcevic | 52/802 X |
| 3,760,548 | 9/1973 | Sauer et al. | 52/309.11 X |
| 3,837,134 | 9/1974 | DiFazio | 52/809 |
| 3,941,180 | 3/1976 | Thill | 160/229 R |
| 3,967,671 | 7/1976 | Stanley et al. | 160/232 |
| 4,028,859 | 6/1977 | Bellagamba | 52/795 X |
| 4,119,133 | 10/1978 | Wolf | 160/232 X |

FOREIGN PATENT DOCUMENTS

| | | | |
|---|---|---|---|
| 2258510 | 8/1975 | France | 52/309.9 |

*Primary Examiner*—Alfred C. Perham
*Attorney, Agent, or Firm*—Blanchard, Flynn, Thiel, Boutell & Tanis

[57] ABSTRACT

Closure panel having high heat insulative capacity. There has been designed for a building opening a closure having a higher heat insulative capacity than has previously been available. There are provided inner and outer panels of high structural strength, such as steel, with means providing for the physical connection with thermal separation thereof. The space between said panels is filled with a foam material, foamed in place, which further provides for the mechanical connection but thermal separation of said inner and outer panels.

9 Claims, 4 Drawing Figures

HEAT INSULATED DOOR

FIELD OF THE INVENTION

The invention relates to door construction wherein there is provided an outer shell of a rigid heat conductive material, such as steel, and an inner supportive but heat insulating material such as a plastics foam, same being characterized by means providing for the mechanical connection but heat separation of inner and outer portions of said shell.

BACKGROUND OF THE INVENTION

In the design of thermally resistive doors, it has long been known to provide a generally boxlike metallic shell and to fill same with some form of insulative material such as a plastics foam, usually foamed in place. These have been highly satisfactory due to the structural strength provided by the metal shell which is usually of rolled steel sheet, and the insulative quality of the plastics foam. However, since such constructions have normally involved a fully boxlike design, this has meant that there was a metallic connection between the inner and outer panels thereof and hence a highly heat conductive path therebetween. While this has not destroyed the value of an insulative door as described, it has nevertheless diminished its full insulative potential. Hence, it has long been desired to provide a door having both the structural strength and the surface resistance to impact obtained from the steel boxlike construction together with the heat insulative qualities of the foam filling, yet in some manner to interrupt the previously existing heat conductive path between the inner and outer panels thereof. Previous attempts to do this have often merely substituted other heat conductive paths, resulted in a weaker door or made it impossible to use a foam which is injected under pressure into the interior of the door.

Accordingly, the objects of the invention include:

1. To provide a heat insulative door having a maximum level of heat insulative qualities without sacrifice in structural strength or surface impact resistance.

2. To provide a door, as aforesaid, which can be fully sealed in order to render possible the use of a pressure injected foam into the cavity therewithin.

3. To provide a door, as aforesaid, whose metallic parts can be made of easily rolled sheet metal components which are of simple design and which can be readily assembled by simple techniques.

4. To provide a door construction, as aforesaid, utilizing seals of plastics material which are of simple design and readily extrudable to hold the cost thereof to a minimum.

5. To provide a door, as aforesaid, whose basic design can be expressed in a variety of different specific designs as desired to meet a variety of particular building closure requirements, all of which will require only components of relatively simple design which can be inexpensively assembled but which will provide a high degree of satisfaction in use.

Other objects and purposes of the invention will be apparent to persons acquainted with products of this general type upon reading the following specification and inspection of the accompanying drawings.

DETAILED DESCRIPTION

Turning now to the drawings, there is shown a horizontally hinged, sectional, upwardly retractable door which excepting for the details set forth below is of a construction familiar for a variety of vertically liftable doors, such as garage and warehouse doors, doors for the rear ends of trucks, airplane hangar doors and similar. Insofar as the present invention is concerned, the door may have any number of sections, the sections may be hinged together in any manner and for that matter the hinging may be on vertical axes as well as on the illustrated horizontal axes. Thus, the present illustration of a typical door to which the invention is applied is for illustrative purposes only and not limiting.

Figure 1:
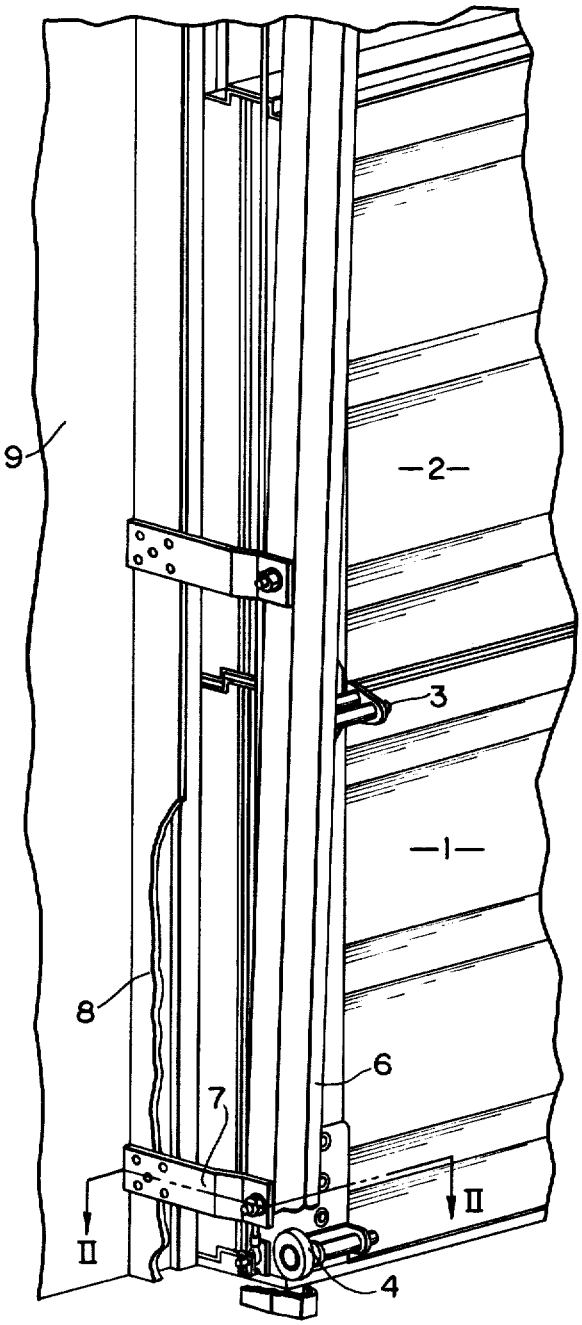
FIG. 1 is an oblique view of one portion of an assembled door.

Referring to FIG. 1, there are shown sections 1 and 2 of a horizontally sectioned door. A hinge 3 connects said sections 1 and 2 in a conventional manner and a roller 4 is mounted in any desired manner at the bottom of the door for guiding in a side channel 6 for the usual purposes. The channel 6 is mounted conventionally by means of straps 7 to a rearward angle 8 which is then mounted to the basic building 9 is any desired manner. A jam seal 10 is provided to the angle 8 for contact with the outer surface of the door 1 to prevent passage of air therebetween.

Figure 2:
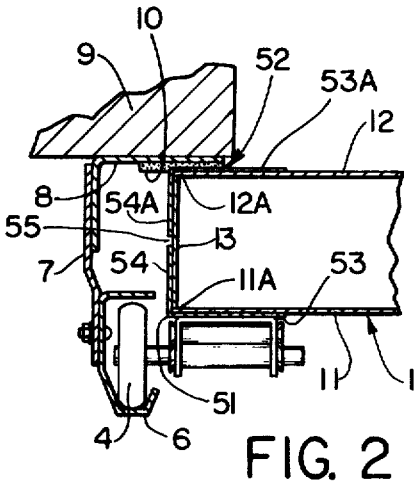
FIG. 2 is a section taken on the line II—II of FIG. 1.

Turning now to the details of construction of a door section and with specific reference for illustrative purposes to section 1, there is provided an inner panel 11 and an outer panel 12. These panels are mirror images of each other which further diminishes both the initial cost thereof and the cost of inventorying. Referring to the panel 11, same is of rolled construction and hence the lateral or stile edges 11A and 12A (FIG. 2) thereof are free from flanges or other bent-over portions. Instead, such stile edge is closed by a sealing strip 13 which is positioned and held in place as set forth more fully hereinafter. The panel 11 is provided with a series of indentations 14 (FIG. 3) for strengthening purposes and both its upper and lower edges are provided with flanges 16 and 17, respectively. Flange 16 has a first portion 18 which is bent at substantial right angles to the upper edge of the panel 11. A second portion 19 extends perpendicularly upward from the first portion 18. A third portion 21 is perpendicular to the second portion 19 and parallel with the first portion 18. A re-entrantly bent portion 22 is perpendicular to the third portion 21 and extends parallel to the main body of the panel 11 in an inward direction with respect to said section 1. A fifth flange 23 extends along the inner edge of the fourth portion 22, is perpendicular thereto and extends back toward the main body of the panel 11. The lower flange 17 is generally similar to the upper flange 16 excepting that its second portion 27 extends inwardly of the door instead of outwardly as does portion 19 of the upper flange 16. Thus, the lower flange 17 has a first portion 26 extending perpendicularly to the main face of the panel 11, a second portion 27 extending upwardly and perpendicular to the first portion 26, a third portion 28 continuing inwardly and perpendicular to the second portion 27, a fourth portion 29 extending parallel with the main face of the panel 11 and centrally thereof and a final edge flange 30 perpendicular to the fourth portion 29.

The outer panel 12 is provided with an upper flange 31 and a lower flange 32 which have the same sectional construction in mirror image as the above-described flanges 16 and 17 and hence need no further description.

Figure 3:
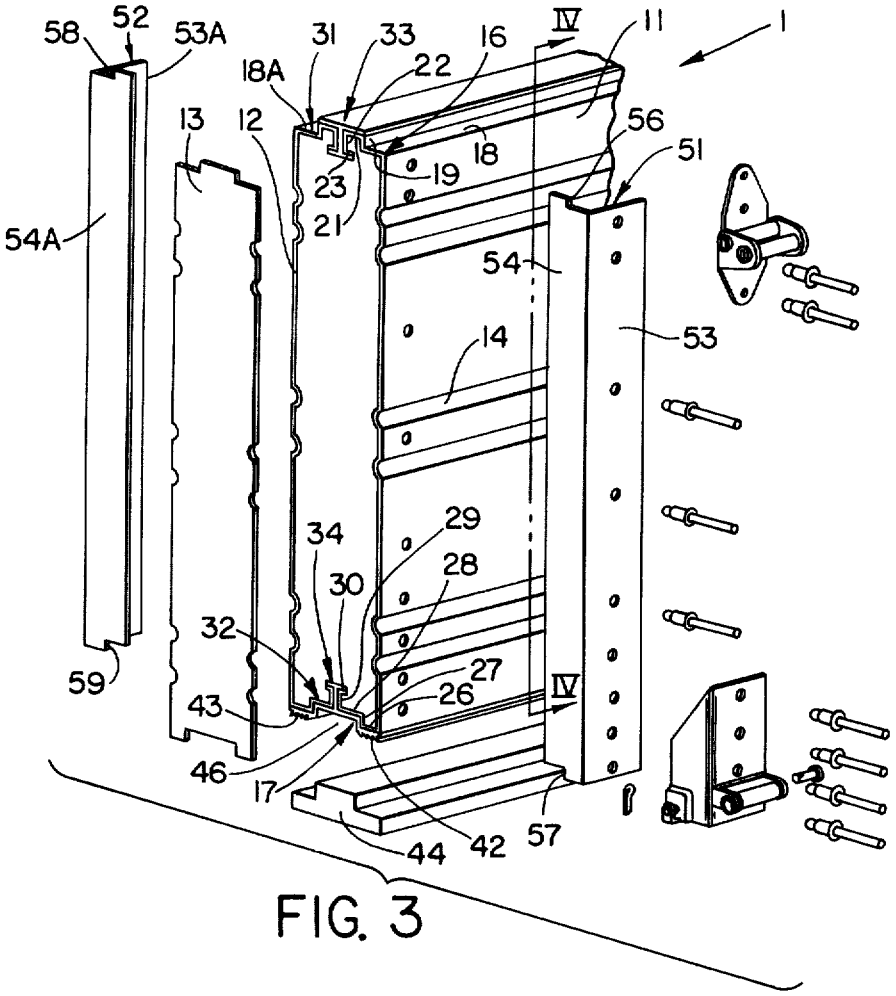
FIG. 3 is an exploded view of a portion of the door showing the details of its construction.
Figure 4:
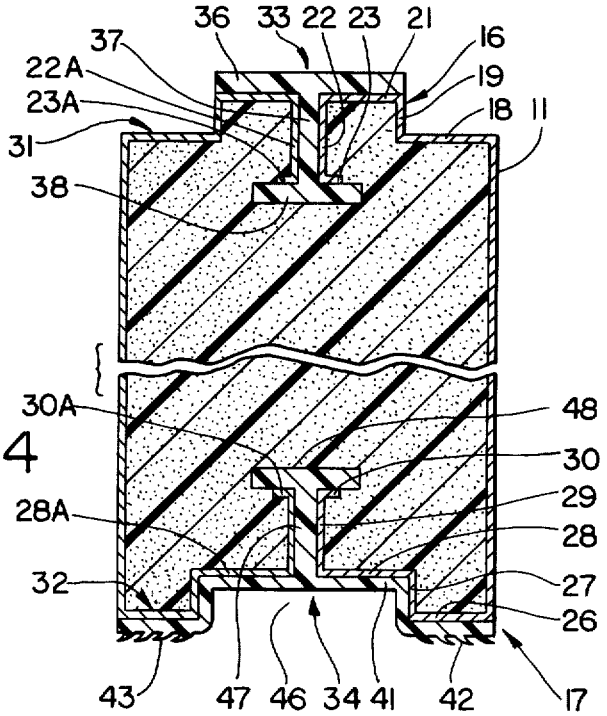
FIG. 4 is a broken sectional view taken on line IV—IV of FIG. 3.

Sealing strips 33 and 34 are provided for positioning between the panels 11 and 12 as shown in FIGS. 3 and 4. This provides the final seal between said inner and outer panels to insure that when foam is injected thereinto under pressure it will not escape therefrom but will instead fill all portions of the interior cavity of the door fully and completely. The sealing strip 33 has an outer portion 36 generally overlying and shaped to conform to the upper part of the door section 1 for protective purposes. Depending from said portion 36 is a flange, or body portion, 37 which extends between the fourth portion 22 of the flange 16 and its counterpart 22A of flange 31. A seal flange 38 is attached to the lower end of the flange 37 and extends under and is in contact with the edge flange 23 and its counterpart 23A in flange 31. The dimensioning of the parts is such that said flange 38 lies snugly against the contacting flanges 22 and 23A for reasons appearing more fully hereinafter.

The sealing strip 34 has a similar outer section 41 lying snugly against the third portion 28 of flange 17 and its counterpart 28A in flange 32. In this embodiment, the portion 41 also carries sealing strips 42 and 43 for the purpose of sealing the section 1 against the next lower component. In this case, such next lower component is the bottom strip 44 shaped and dimensioned to fit into the recess 46. In the case of an upper section such as section 2, the strips thereon corresponding to the strips 42 and 43 will bear against the portion 18 of flange 16 and the corresponding section 18A of flange 31 in order to seal tightly any space existing between sections 1 and 2. Portion 41 has a flange 47 upstanding therefrom which carries at its upper end a sealing flange 48 which extends beyond and lies snugly against the flange 30 and its counterpart 30A on the flange 32.

Corner stile sections 51 and 52 are provided as shown. The corner stile section 51 has a flange 53 lying against the inner surface of the inner panel 11 and a flange 54 overlying the end of such panel. Preferably the respective ends of the flange 54 are shaped appropriately as at 56 and 57 for conforming to the profile of the flanges 16 and 17. The corner stile member 52 has a flange 53A overlying the surface of the outer panel 12 and an end flange 54A for overlying the end of said outer panel 12. The respective ends of the flange 54A are shaped at 58 and 59 respectively to conform to the profiles of the flanges 31 and 32. It will be noted in FIG. 2 that the flanges 54 and 54A are dimensioned so that they do not quite meet and hence a heat insulative space 55 is provided between their opposing edges.

The vertical edge of the door opposite the illustrated edge is a mirror image thereof and hence separate illustration or description is unnecessary.

In assembling the parts above described, the inner and outer panels 11 and 12 are positioned relative to each other as shown in the drawings and the sealing members 33 and 34 slid endwise into place as shown. The end seal 13 is then positioned and the corner members 51 and 52 are placed and fixed by any convenient means such as bolts. In the illustrated embodiment, the heat transmittal by through bolts is avoided by using bolts as shown which extend into the interior of the door and are held in place by the foam. The foam is then injected, as desired, through an opening which is subsequently closed by suitable means. For example, the foam may be injected through an opening in the seal 13 which opening is then covered by the flanges 54 and/or 54A. The solidified foam will seize and firmly hold the bolt inner ends as well as the flanges 38 and 48 of the seals 33 and 34 and the adjacent portions of the inner and outer panels 11 and 12. The seals 33 and 34 prevent the escape of foam from the space between the inner and outer panels 11 and 12 and will make it possible for metallic panels to be spaced from each other. Similarly the end seals, as the seal 13, can contain the foam being injected between the panels 11 and 12.

It will be observed that when said foaming material is inserted into the cavity within the door under pressure, that there will be a differential pressure created adjacent both of said sealing means, which differential pressure will assist in holding said sealing means firmly in place during the foaming operation. Particularly, and referring to the sealing means 33, there will be developed on said sealing means an outwardly directed pressure extending along the entire inwardly facing area of that part of sealing flange 38 thereof lying against the flanges 23 and 23A while at the same time pressure on the upper side of the flanges 23 and 23A will urge same downwardly against the sealing flange 38.

Thus, the foam pressure within said cavity will tend to press said sealing flange 38 and said flanges 23 and 23A snugly together over a much wider surface than that by which said foam will endeavor to penetrate between member 38 and said flanges. This effectively seals said parts and prevents escape of foam from within said cavity.

The same relationship exists with respect to the sealing member 34 and the flanges 30 and 30A. Thus, while it is desirable for said sealing members to fit snugly against the respective flanges 23 and 30 and the counterparts 23A and 30A on panel 12 and they should upon assembly be at least in contact with each other, pressure therebetween is not relied upon for effecting such seal and the seal is instead assured as above described.

Thus, there is provided a door structure which is made sufficiently of metal to provide a strong and rigid construction together with good impact and abrasion resistance at its inner and outer surfaces while at the same time providing for complete interruption of metallic connection between the inner and outer portions of the door so as to minimize the passage of heat therethrough. Further, said door is arranged for appropriate sectioning, and pivoting between sections, and yet providing adequately for sealing between the sections, sealing between the bottom section and the floor and sealing of the entire door as by the seal 11 between the inner surface thereof and the building with which said door is used. Thus, there is provided a high level of resistance to passage of heat through or around said door and yet the door while strong and damage resistant remains of relatively simple and economic construction. Although a particular preferred embodiment of the invention has been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. In a heat insulative door, the combination comprising:

inner and outer metallic panels approaching but not contacting each other at opposite first and second edges thereof;

first sealing means of highly heat insulative material positioned between said panels at said first and second edges for preventing the escape of flowable material from within said panels outwardly thereof;

second sealing means closing opposite third and fourth edges of said panels;

heat insulative foamed material inserted under pressure into the space between said inner and outer panels and prevented from escaping therebetween by said first and second sealing means, the combination being further comprised in that said panels approach each other at said first and second edges with outer surfaces in turn carrying reversely bent parallel portions extending inwardly of said door and terminating in flanges extending away from each other, said first sealing means having an elongate base element extended inwardly of said door along and snugly between said parallel portions and an inner cross element on the inward end thereof lying against said flanges and an outer cross element on the outward end thereof lying against said outer surfaces, said foamed material bearing against said flanges and said inner cross element to urge same snugly together in a tight seal.

2. The device of claim 1, wherein said first sealing means outer cross element is wider than said inner cross element, said inner cross element extending beyond said panel flanges.

3. The device of claim 1, in which the approaching first edges of said panels are formed as spaced back-to-back C-shaped sections, said C-shaped sections being comprised of said outer surfaces, reversely bent parallel portions and flanges, said first sealing means being formed an an I-shaped section comprised of said elongated base element connected at its opposite ends to said inner cross element and to said outer cross element, said C-shaped edge sections of said panels being inserted snugly between the inner and outer cross elements of said I-shaped first sealing means.

said foamed material including a major central body engaging said inner cross element, said foamed material further including arms extending from said body into the opposite facing concavities formed by the I-shaped sealing means and lined by the C-shaped edge sections of said panels, said flanges and inner cross element being clamped by their respective engagement with said arm and body of said foamed material to effect a seal therebetween, said arms of foamed material also holding therebetween the back-to-back C-shaped edge sections sandwiching therebetween the elongate base element of the first sealing means.

4. The device of claim 3, in which said foamed material arms bear inward on the outward faces of said inner cross element of said first sealing means.

5. The device of claim 1, in which the first sealing means at said second edge has its said outer cross element extended from the outer end of said base element widthwise of the door to free end portions adjacent the interior and exterior surfaces of the door, said free end portions having sealing strips of fingerlike cross-section cantilevered therefrom to engage and seal against an opposing surface upon closing of the door.

6. The device of claim 5, in which said door comprises several door sections each comprising a said inner and outer panel, said door sections being hinged to oppose the first edge portion of a first said door section against the second edge of a second said door section upon closing the door, said first edge portion being stepped in cross-section to form a central tongue incorporating the corresponding said outer surfaces, the outer cross element of the corresponding first sealing means extending the cross-sectional width of said tongue, said second edge portion being stepped in cross-section to form a central groove incorporating the corresponding said outer surfaces, the outer cross element of the corresponding first sealing means extending the width of said groove then being stepped out of said groove to form a corresponding recess and then extending widthwise of said door to form said free end portions, said tougue and the outer cross element of its corresponding first sealing means of one door section being receivable in said recess of the outer cross element of the other said first sealing means with said fingerlike sealing strips engaging edge surfaces of the adjacent door section laterally outboard of said tongue.

7. The device of claim 1, wherein said second sealing means includes a closure member profiled to fit the profile of each of said third and fourth edges, L-shaped corner members mounted by one of their respective flanges on said inner and outer panels and with the other of their respective flanges overlapping said closure member and holding same snugly in position, said last-named flanges of said corner members approaching toward but being spaced from each other, and means holding said corner members in position.

8. The device of claim 7, in which said door has several sections and including means mounting said door sections with respect to each other at an opening in a wall for closing such opening, said mounting means being fixed to said door sections through the inside one of said flanges of said L-shaped corner members, and including a jam seal strip interposed between the outside one of said flanges of said L-shaped corner members, and the wall adjacent said opening.

9. Insulative construction for a door panel comprising a pair of first and second metallic panels positioned substantially parallel to each other, an opposed pair of edges of said panels carrying back-to-back substantially C-shaped flange units each comprising a first flange, a slot defining flange and a sealing flange;

said first flanges being connected substantially perpendicular to each of said panels and extending toward each other;

said slot defining flanges extending parallel to each other and each thereof being affixed respectively to one of said first flanges and perpendicular thereto, said slot defining flanges being spaced from said other across a slot and extending inwardly of said door;

said sealing flanges being fixed at the inner edges of said slot defining flanges and extending respectively away from each other to end in respective free edges opposed to and spaced from the interior faces of the respective panels;

a substantially I-shaped sealing member of heat insulative material having an elongate body portion extending and snugly sandwiched between said parallel slot defining flanges, said sealing member further having outer and sealing portions spaced remotely apart at the outer and inner ends of said elongate body portion and a sealing portion positioned perpendicular to said body portion, said sealing portion extending on each side of said body portion and lying closely against said sealing flanges;

a foamed plastic heat insulative material between said first and second panels and including arm portions expanded into the space between the first and sealing flanges of said back-to-back C-shaped flange units holding said slot defining flanges face-to-face with said elongate body portion of said sealing member, said sealing flanges and said seal member being clamped snugly together in face-to-face sealing relationship by surrounding portions of said foam material.

* * * * *